US005269119A

United States Patent [19]

Tolson

[11] Patent Number: 5,269,119

[45] Date of Patent: Dec. 14, 1993

[54] LINEARLY RECIPROCATING CONVEYOR APPARATUS

[75] Inventor: Sidney S. Tolson, Scotland Neck, N.C.

[73] Assignees: Ossid Corporation, Rocky Mountain, N.C.; Ibaraki Seiki Machinery Company, Ltd., Ibaraki, Japan

[21] Appl. No.: 30,729

[22] Filed: Mar. 12, 1993

[51] Int. Cl.[5] ..... B65B 61/28; B65B 51/30; B65B 41/12

[52] U.S. Cl. ..... 53/374.5; 53/550; 198/343.1; 198/586; 198/626.5; 198/861.1

[58] Field of Search ..... 198/343.1, 586, 626.5, 198/861.1; 53/450, 550, 553, 374.3, 374.4, 374.5, 376.2, 374.9, 371.3, 371.5, 548

[56] References Cited

U.S. PATENT DOCUMENTS

| | | | |
|---|---|---|---|
| 1,586,375 | 5/1926 | Metcalf | 53/375.9 X |
| 3,075,326 | 1/1963 | Waite | 53/375.9 X |
| 3,344,902 | 10/1967 | Crawford | 53/586 |
| 3,618,740 | 11/1971 | Taverna | 198/343.1 |
| 4,553,377 | 11/1985 | Klinkel | 53/550 X |
| 4,870,802 | 10/1989 | Cerf | 53/450 X |
| 5,014,496 | 5/1991 | Davis et al. | 53/450 X |
| 5,237,800 | 8/1993 | Omori | 53/450 X |

*Primary Examiner*—Horace M. Culver
*Attorney, Agent, or Firm*—Olive & Olive

[57] ABSTRACT

In a film packaging machine wherein a pair of sealing bars are caused to move linearly with said film so as to increase the sealing cycle time, a pair of control belts are mounted so as to reciprocate in unison with said sealing bars. The control belts, which are oriented vertically at opposite edges of a central product conveyor and adapted to grip a product being wrapped, are rotated from a drive apparatus mounted to the machine body at a speed which equals the linear speed of reciprocation. Thus, the control belts do not rotate when the reciprocating motion is in the same direction as the direction in which the film and product move, and rotate at double the linear speed of reciprocation when the reciprocating motion is in the opposite direction.

14 Claims, 4 Drawing Sheets

LINEARLY RECIPROCATING CONVEYOR APPARATUS

BACKGROUND OF THE INVENTION

1. Field of the Invention

This invention relates to conveyor apparatus, and more particularly to conveyor apparatus used in machinery for packaging of products in film wrap.

2. Description of the Related Art

A commonly used method of packaging items for sale involves wrapping the item in a sheet of film and sealing the film around the item. This method has been commercially employed for the packaging of food items, such as, for example, poultry products. In many industrial horizontal packaging machines, the poultry product is fed into a longitudinally sealed tube formed of the film wrap and then the tube is sealed transversely ahead of and behind the poultry product. This sealing is typically done by thermal or ultrasonic welding techniques using sealing bars.

As wrapping equipment has been made to operate faster, it has become necessary to modify the manner of conveying the poultry product, frequently transported in a tray, in order to maintain firm control of the product during packaging and also during weighing and labelling operations. One means of improving the control comprises the use of vertical conveyor belts placed so as to engage opposite sides of the tray to enhance the synchronization of the product tray motion with the machine motions. See, for example, U.S. Pat. No. 5,137,099 with respect to use of vertical control belts in a weighing and labelling operation.

In order to improve the process speed and to maintain reliable film seals, there has been developed a mechanism able to cause the sealing bars which form the transverse seals to travel along with the film, and thus increase the seal cycle time. Such a mechanism is disclosed in Japanese patent application No. 4,121,444 for Packaging Machine Seal Mechanism and Control by Suga filed Apr. 15, 1992, the contents of which are deemed incorporated herein by reference.

In addition to the inherent problems associated with handling trays of poultry at high production speeds, the air within the wrapper is often evacuated so that a minimum of air is available within the wrap. This reduced quantity of air retards the natural degradation of the poultry, thus preserving it in useful condition for a longer time. However, the vacuuming needed to remove the air is powerful and rapid, thereby tending to pull the poultry toward the vacuum source. Since the most effective time to apply this vacuum is at the last instant before completing sealing of the package, the vacuum attempts to pull the poultry product from the partially sealed package.

In applicant's copending application Ser. No. 07/967,403 filed Oct. 28, 1992 entitled "Belt Conveyor Providing A Controllable Length of Belt Run", there is provided a conveyor system having a reciprocable frame. The reciprocable frame mounts a horizontal conveyor belt, a pair of vertical control belts, or both, upstream of the sealing mechanism. The belts are normally in continuous rotation. When the frame reciprocates, the length of belt contacting the product lengthens and shortens and in doing so provides an effective means for firmly gripping and conveying the product upstream of the sealing head mechanism and to and through the sealing head mechanism. However, there remains a need for an improved conveyor belt system capable of firmly gripping and conveying the product downstream from the sealing mechanism.

It is therefore an object of this invention to provide an improved conveyor apparatus capable of controlling a product while being transported through a packaging machine particularly when being transported downstream from the sealing mechanism.

It is an additional object of this invention to provide an improved conveyor apparatus to control a product being transported while being packaged and during application of a vacuum to exhaust air from within the package being formed.

Other objects and advantages will be more fully apparent from the following disclosure and appended claims.

SUMMARY OF THE INVENTION

The present invention provides a novel reciprocating control belt conveyor apparatus operative, in conjunction with horizontal conveyor belts, located respectively upstream and downstream of the sealing mechanism in a film wrapping machine having transverse sealing bars, to grasp and transport a product being wrapped in a film. The control belt conveyor system of the invention is mounted on a frame which reciprocates downstream of the sealing mechanism in a line parallel to the horizontal conveyor belts. While broadly applicable to both horizontal and vertical belt conveyors, in the preferred form, the control belts incorporated within the conveyor apparatus of the invention are oriented vertically and are driven by a drive belt or chain from the main machine drive apparatus. The drive belt or chain operates at a selected linear speed so that when the frame carrying the conveyor apparatus of the invention reciprocates in the same direction as the direction of movement of the drive belt or chain, the rotating speed of the control belts is zero. This arrangement permits the control belts to be advanced, while being rotated, toward the sealing mechanism to receive a product from the sealing mechanism and then to be moved away from the sealing mechanism, while grasping the product but while not being rotated, to discharge the product.

DETAILED DESCRIPTION OF THE INVENTION AND PREFERRED EMBODIMENTS THEREOF

Figure 1:
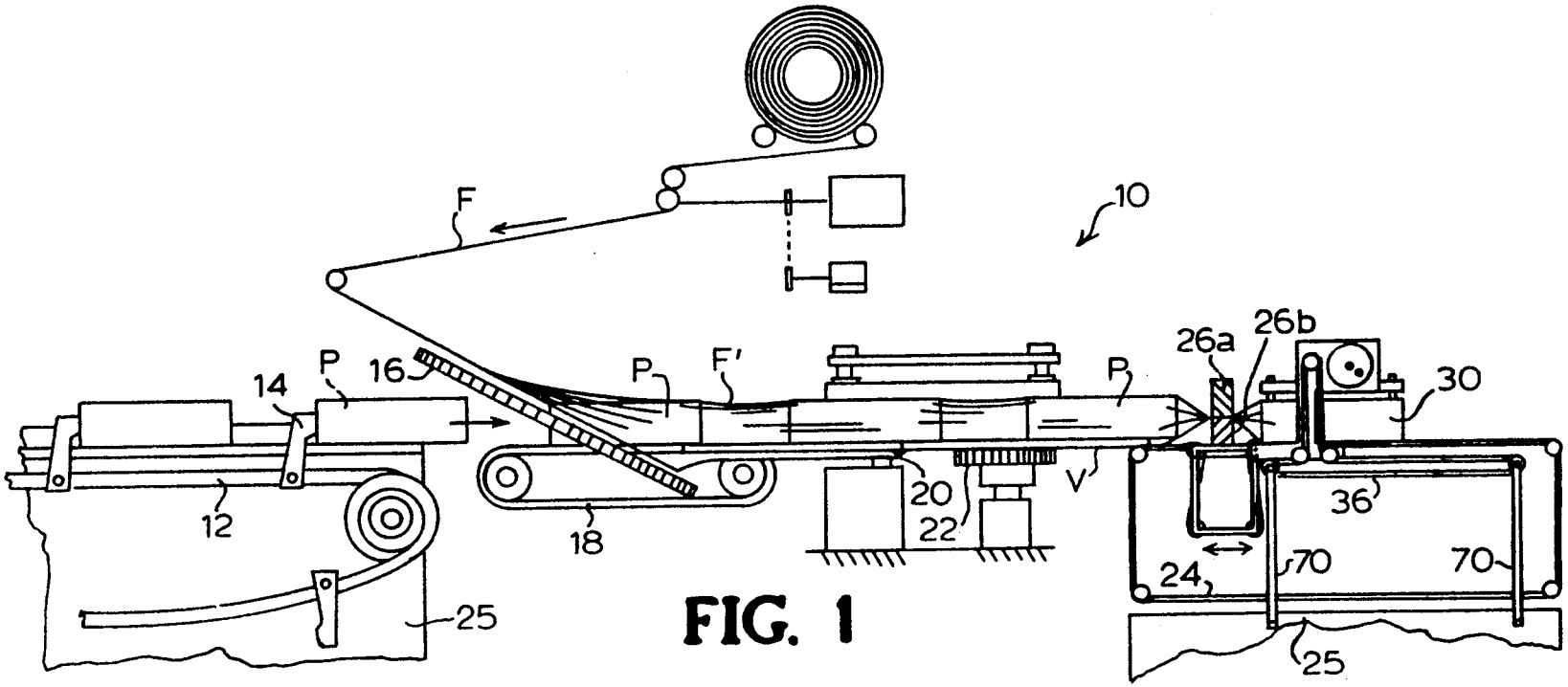
FIG. 1 is a schematic side elevation view of a film wrapping machine of the prior art including the improvement of the present invention.

The prior art is first reviewed for background. In this regard, the illustration of FIG. 1 portrays a prior art wrapping machine 10, embodying the improvements of the present invention. The film wrapping machine 10 shown has an infeed section conveyor 12, central section conveyor 18 and moving gap output conveyor 24 which are generally mounted so as to be able to operate in a common horizontal plane on machine body 25. Infeed conveyor 12 has a series of push lugs 14 adapted to drive products P. As products P are moved forward, film F is drawn from a supply roll and carried gradually down by a pair of opposed film clamp chains 16 so as to be wrapped tubularly around a series of products P. Clamp chains of this type are illustrated in U.S. Pat. No. 4,841,715, the contents of which are incorporated herein by reference. As film F moves beyond clamp chains 16, the edges of film F are brought together by converging belts 20 to pass between sealing wheels 22 to create a sealed longitudinal seam. The film sealing may be performed either by thermal or other means as are known. The film products P, now enclosed in film tube F' are moved farther along to the moving gap output conveyor 24, configured to accommodate a reciprocating sealing bar mechanism 26*a*, 26*b* of the type shown in Japanese Patent Application No. 4,121,444, the contents of which, as previously noted, are incorporated herein by reference.

Figure 3:
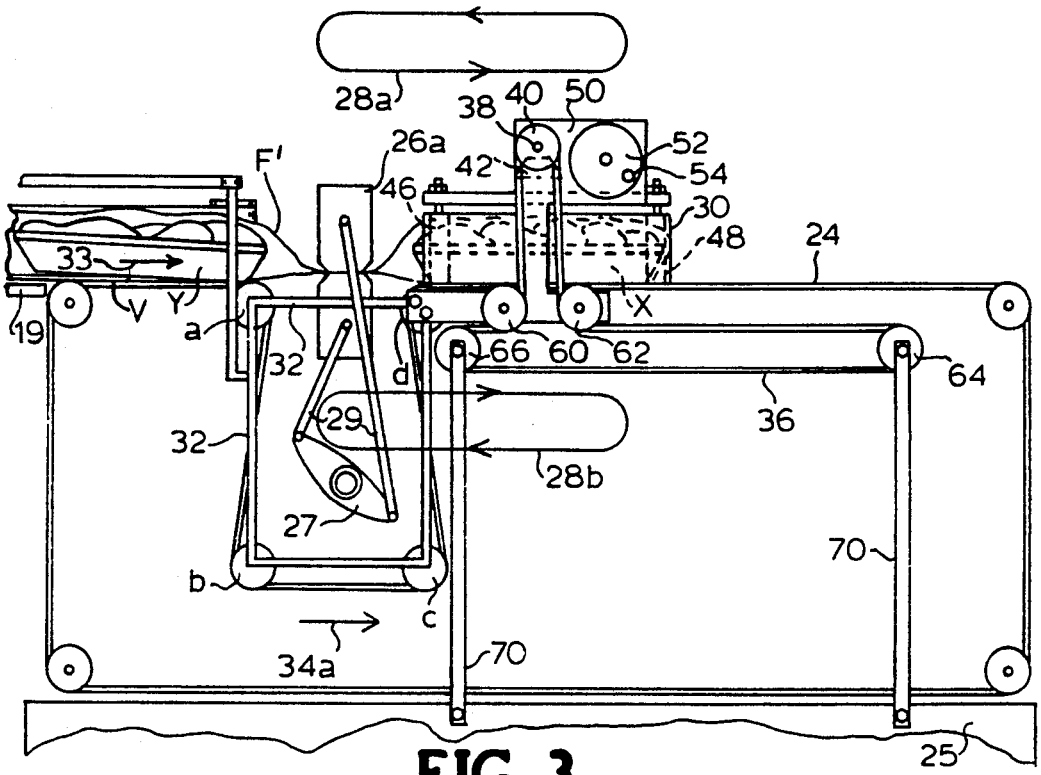
FIG. 3 is a side elevation of the apparatus of FIG. 2 with the sealing bars closed and the conveyor belt gap in an upstream position.
Figure 4:
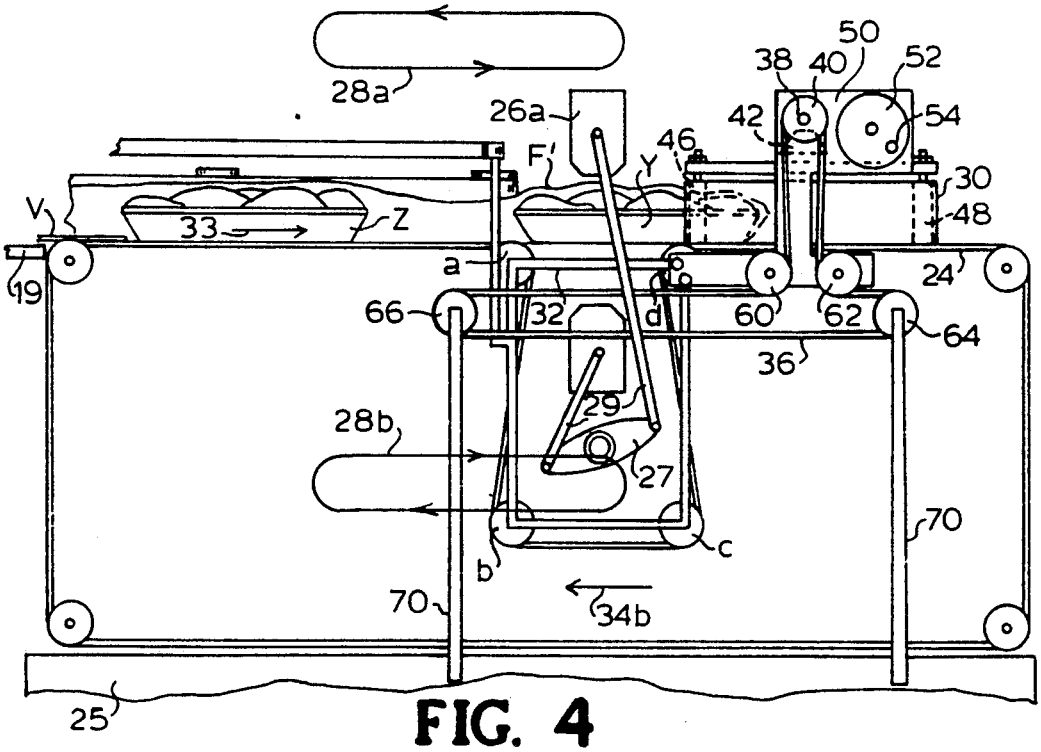
FIG. 4 is a side elevation view of the apparatus of FIG. 2 with the sealing bars open and the conveyor belt gap in a downstream position.

Immediately before sealing bars 26*a*, 26*b* clamp film tube F', a vacuum is drawn by a vacuum source through a vaccuum tube V within film tube F' to remove as much air as possible and thus retard product degradation. Sealing bars 26*a*, 26*b* are actuated by linkage 27 and connecting rods 29 which operate as illustrated in FIGS. 3 and 4 to cause sealing bars 26*a*, 26*b* to clamp transversely across the film tube F' at a point close to the end of central conveyor 18. While clamped together, sealing bars 26*a* and 26*b* move in the same direction as central conveyor 18 and product P. When sealing bars 26*a*, 26*b* reach the end of their forward travel, they are caused to separate by cam and lever means (not shown) and travel in the opposite direction to return to their starting point and then repeat the process. The travel path of sealing bars 26*a*, 26*b* is generally in the direction indicated by elliptical loops 28*a*, 28*b*, illustrated in FIGS. 3 and 4. Immediately beyond sealing bars 26*a*, 26*b* in the forward travel direction are vertically oriented control belts 30 of the invention, adapted to hold product P firmly as the air is being removed by vacuum from film tube F' and product P is being moved forward during sealing.

What has thus far been described refers to the type of poultry packaging apparatus known in the art. Therefore, it has only been described with limited detail for background and reference. The description next turns to a more detailed description of the invention apparatus.

Figure 6:
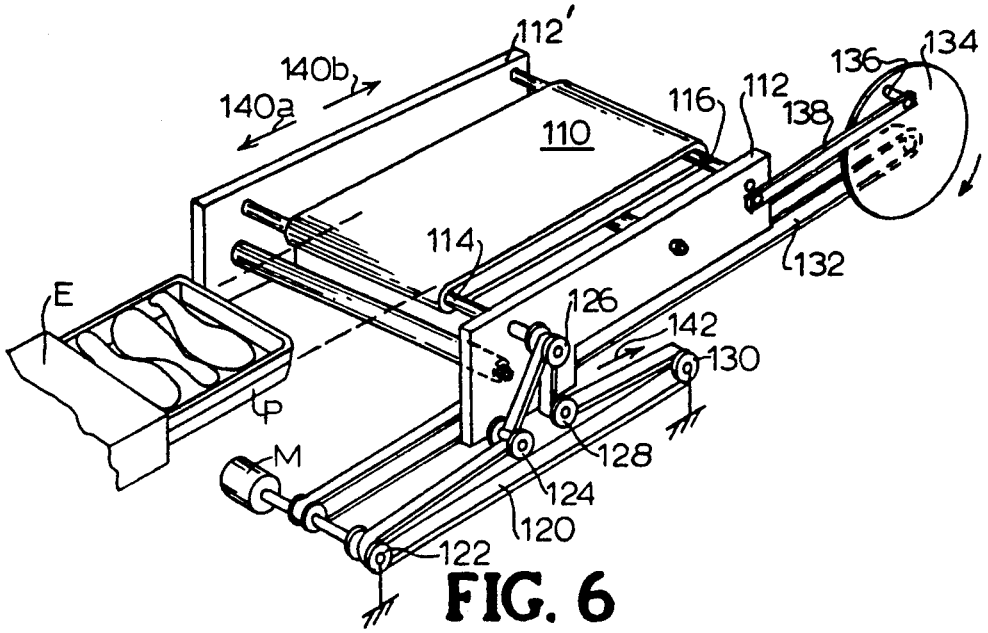
FIG. 6 is a perspective schematic view of the principal elements of the apparatus of the invention in basic form and shown applied to a reciprocating conveyor belt oriented horizontally.

The principal elements of the invention apparatus are best illustrated in simplified and schematic form in FIG. 6 without the prior art gap conveyor apparatus and in reference to a machine, used by way of example, from which the product is assumed to exit through exit means E. Reciprocating, horizontally oriented conveyor belt 110 is mounted on and rotates around driving shaft 114 and idler roller 116 which are supported on interconnected reciprocating plates 112, 112'. Driving shaft 114 carries shaft pulley 126 which is driven by belt 120. Belt 120 is driven by motor M through driven pulley 122 which is fixed in location, and belt 120 winds around idler pulley 130 which is also fixed. Belt idlers 124, 128 and shaft pulley 126 are all mounted on reciprocating plate 112 so as to move in the directions indicated by arrows 140*a*, 140*b* synchronously with conveyor belt 110. Motor M also drives wheel 134 through belt 132, and eccentric arm 136 and link 138, in turn, drive reciprocating plates 112, 112' linearly. The drive speeds of belt 120 and plates 112, 112' are matched. When conveyor belt 110 reciprocates with plates 112, 112' in the direction of arrow 140*b*, which is the same direction as the motion of drive belt 120 (shown as arrow 142), conveyor belt 110 does not rotate. However, when conveyor belt 110 reciprocates in the direction of arrow 140*a*, opposite to arrow 142 of belt 120, conveyor belt 110 rotates. This action causes conveyor belt 110 to rotate as it reciprocates toward product P which is being released from machine exit means E and, when conveying product P to move back without rotation. For proper control, frame plates 112, 112' do not travel farther than the points at which either idler 124 overlies driven pulley 122 or, alternatively, idler 128 overlies fixed pulley 130.

To summarize the invention as just explained in reference to FIG. 6, the conveyor apparatus of the invention can be said to broadly comprise:

(a) a belt conveyor having a run capable of engaging and conveying a product contacting the run;
(b) a reciprocable frame mounting said belt conveyor;
(c) means for reciprocating said frame along a linear path; and
(d) means for driving said belt conveyor in coordination with reciprocation of said frame wherein when said frame reciprocates and moves said run in a first direction to an entry position suitable for engaging a product, said belt conveyor is driven, and when said frame next reciprocates and moves said run in a second opposite direction, said belt conveyor is not driven and causes said run to convey said product for the extent of said next reciprocation to an exit position.

Figure 7:
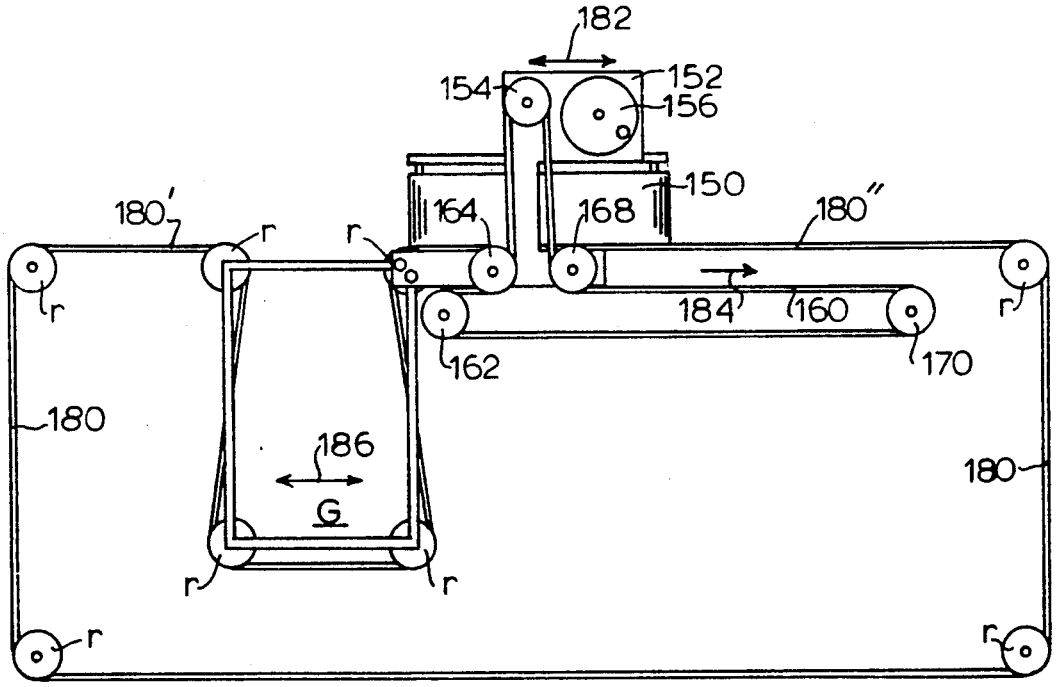
FIG. 7 is a side elevation schematic view of the principal elements of the invention apparatus shown applied to vertically oriented conveyor belts associated with the prior art gap conveyor apparatus.

The novel reciprocating conveyor apparatus as just broadly described in reference to FIG. 6, is practically utilized in conjunction with a horizontal gapped conveyor belt in the preferred embodiment, as further schematically illustrated in FIG. 7. In this embodiment, the conveyor belts 150 of the invention are oriented vertically. Gapped conveyor belt 180 runs on rollers in the direction of arrow 184 as gap G reciprocates as shown by arrow 186, thus causing product transport surfaces 180' and 180'' to vary reciprocally in length. Vertical control belts 150 (only one being shown in FIG. 7) are rotatably supported on reciprocating plates 152 (only one being shown in FIG. 7) which reciprocate as indicated by arrow 182. Drive belt 160 is wrapped around fixed pulleys 162 and 170, and around pulleys 154, 164 and 168 which are mounted on the illustrated reciprocating plate 152 to move with it. Pulley 154 is connected by shafts and gears (not shown in FIG. 7) to drive control belts 150 and operates at a speed selected so that when the reciprocating members move in a direction which is opposite to the direction in which drive belt 180, control belts 150 rotate; and when the reciprocating members move in the same direction as the direction in which the drive belt 180 moves as shown by arrow 184, control belts 150 do not rotate.

To further broaden an understanding of the invention, the conveyor apparatus of the invention when taken in reference to the described FIG. 7 can be said to comprise:

(a) a pair of vertically oriented opposed belt conveyors each rotatable in a substantially horizontal path separated by a space such that a product located between opposed runs thereof is gripped securely therebetween;

(b) a reciprocable frame mounting said pair of belt conveyors;

(c) means for reciprocating said reciprocable frame along a linear path; and (d) means for driving said pair of belt conveyors in coordination with reciprocation of said reciprocable frame in a first direction to an entry position suitable for engaging a product to be conveyed such that said belt conveyors are driven and next in coordination with reciprocation of said frame in a second direction such that said belt conveyors are not driven.

Figure 2:
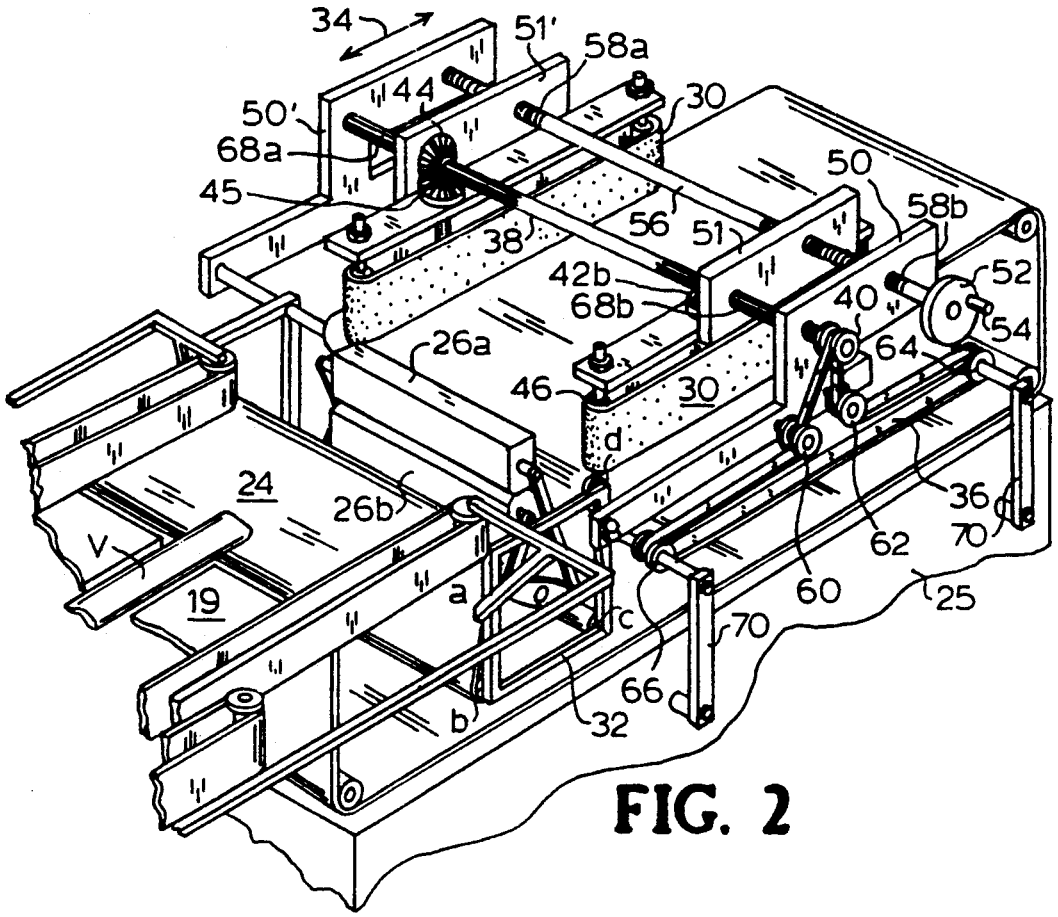
FIG. 2 is a perspective view of a portion of the conveyor belts of the film wrapping machine including the reciprocating conveyor apparatus of the invention.

Having explained the invention somewhat broadly with reference to the schematic FIGS. 6 and 7, the apparatus of the invention is shown and described in greater detail in reference to FIGS. 2, 3 and 4 to which reference is next made. As mentioned above, the sealing bars 26*a*, 26*b*, typically employing heat to seal, are moved in elliptical paths 28*a*, 28*b* in synchronization with film tube F' (shown in FIGS. 3 and 4) which sealing bar movement serves to increase the sealing dwell time, and thus the reliability of the seam created. Gapped conveyor 24 has a split product support surface which is operative in substantially the same plane as the central conveyor support plate 19 (see FIG. 2). The gapped portion of conveyor 24, defined by gap rollers a, b, c, d is reciprocated by frame 32 together with sealing bars 26*a*, 26*b*. Side plates 50 are attached to and move with frame 32, carrying the mechanism of the invention, including vertical control belts 30, forward and rearward.

FIG. 3 shows the sealing bars 26*a*, 26*b* at the time and location at which they have closed to seal the film tube F' between tray X and tray Y at the start of a sealing cycle. Conveyor gap rollers a, b, c, d, which are caused to reciprocate in unison according to the teachings of Suga, are shown in FIG. 3 at the upstream end of the stroke, with respect to the direction of conveyor travel. At this stage of operation, gap rollers a, b, c, d move in the direction of arrow 34*a* together with moving linkage 27, 29 and sealing bars 26*a*, 26*b*. The vertically oriented reciprocating control belts 30 are positioned at opposite sides and above the product conveying surface of gapped conveyor 24 with rotatable belt rollers 46 only one of which is shown in FIGS. 3 and 4) positioned approximately vertically aligned with the downstream moving gap rollers c, d. Reciprocating control belts 30 simultaneously move in the direction of arrow 34*a* when moving from the FIG. 3 to the FIG. 4 position (only one of which is shown in FIGS. 3 and 4). As is seen in FIGS. 3 and 4, plate 50, on which the mechanism actuating control belts 30 is mounted, is attached to frame 32 so that the gap rollers a, b, c, d and the control belts 30 reciprocate linearly together.

FIG. 4 illustrates sealing bars 26*a*, 26*b* and the other reciprocating apparatus at a time later in the cycle depicted. Sealing bars 26*a*, 26*b* have completed the sealing part of the cycle and have been separated from film tube F' by reversal of link 27 to move in the upstream direction as shown by return arrow 34*b*. All the associated components depicted in FIG. 4 are also assumed to be similarly moving in the upstream direction.

At all times, film tube F' and product P continue to move in the direction indicated by arrow 33 (FIGS. 3 and 4). In FIG. 3, tray Y is approaching sealing bars 26*a*, 26*b*. FIG. 4 shows tray Y moving past sealing bars 26*a*, 26*b* and seal film tube F' being sealed ahead of tray Z. It is to be noted that, with regard to the components illustrated in FIG. 3, control belts 30 are being moved linearly in the same direction as the direction in which film tube F' and product P are moving. In FIG. 4, control belts 30 are being moved linearly in the opposite direction from the direction in which film tube F' and product P are moving. Thus, the reciprocating linear motion of control belts 30 in one direction is equalized by the rotating motion of control belts 30 about belt rollers 46, 48, as described above.

Treating the frame 50, 50' which supports the vertical belt conveyors as a "first reciprocable frame", the gap conveyor frame 32 as a "second reciprocable frame", and conveyor belt 24 as a "second belt conveyor", it can be seen from what has thus far been further described in reference to FIGS. 2, 3 and 4 that the conveyor apparatus of the invention further comprises:

(a) a second belt conveyor having a horizontal run portion thereof operable in a direction parallel to the direction of rotation of and located below and between the vertically oriented belt conveyors;

(b) a second reciprocable frame located upstream of said first reciprocable frame and mounting a portion of said second belt conveyor, said second reciprocable frame comprising part of a gap type conveyor used with a reciprocating sealing head mechanism;

(c) means for reciprocating said second reciprocable frame along a linear path in the same direction and in coordination with reciprocation of said first reciprocable frame;

(d) means for continuously driving said horizontal run portion in said second direction;

(e) wherein said first and second reciprocable frames reciprocate from an upstream entry position suitable for engaging a product to be conveyed and next reciprocate in the second opposite direction to an exit position; and (f) said first and second reciprocable frames being connected together and reciprocally driven in unison by a common drive mechanism.

Continuing the more detailed description and as seen in FIGS. 2, 3, 4 and 5, cross shaft 38 is driven by drive belt 36. Belt 36 is, in turn, driven by drive pulley 66 and passes over idler pulley 64 both of which are fixedly mounted on arms 70 and machine body 25. Belt 36 also winds around idler pulley 60, shaft pulley 40 and idler pulley 62, all of which reciprocate in unison. With drive pulley 66 and idler pulley 64 both fixed, and shaft pulley 40 and idler pulleys 60 and 62 all reciprocating with plate 50, the upper loop of belt 36, defined by pulleys 60, 40, 62, reciprocates horizontally. In addition, as plate 50 and cross shaft 38 move in the direction of arrow 34*a* (FIG. 3), similar to the direction 33 of product P, the linear speed of belt 36 coordinates with the speed of plates 50 so that reciprocating control belts 30 are not rotating about the control belt drive rollers 46 and 48. When plate 50 and cross shaft 38 move in the direction of arrow 34*b*, opposite to arrow 33 of product P, the linear speed of belt 36 added to the rotation of shaft pulley 40 causes reciprocating control belts 30 to revolve at a speed equal to twice the linear speed of product P such that reciprocating control belts 30 overtake and surround product P on this upstream reciprocative stroke.

Figure 5:
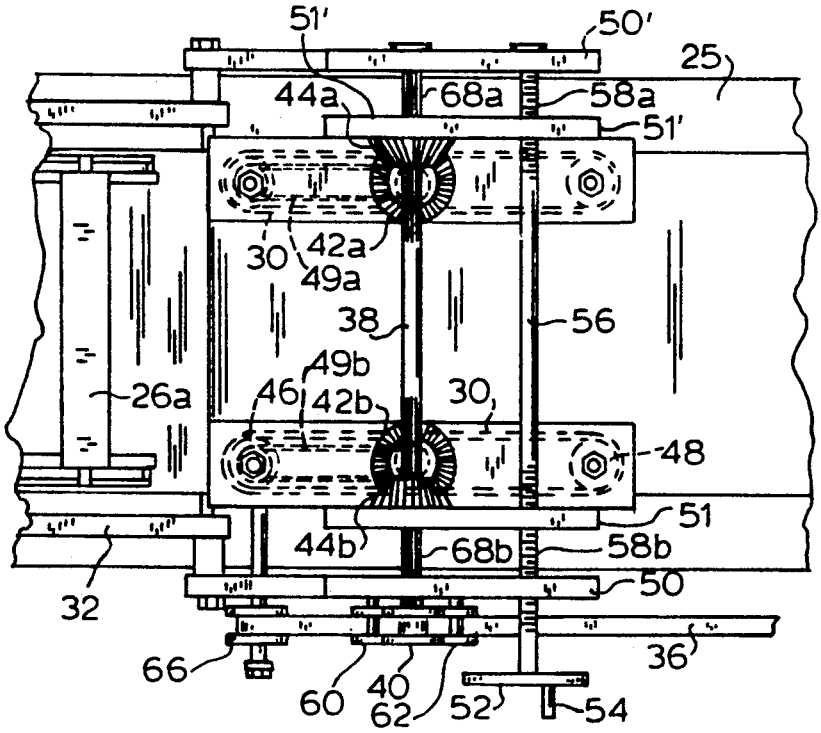
FIG. 5 is a top plan view of a portion of the apparatus of FIG. 2.

The drive mechanism for control belts 30 is shown in top plan view in FIG. 5. Cross shaft 38 passes through reciprocating plate 50 to terminate at opposite reciprocating plate 50'. Plates 50, 50' are also connected by threaded shaft 56 which has opposite left and right threaded portions **58*a*, 58*b* so that rotation of crank disk 52 by crank knob 54 causes laterally adjustable plates 51, 51' to move toward or away from each other, thus decreasing or increasing the space between control belts 30**.

Cross shaft 38 has a linear key or spline portion **68*a*, 68*b* at either end so that as plates 51, 51' move, horizontal bevel gears 44*a*, 44*b*, meshed with vertical based gears 42*a*, 52*b* mounted thereon maintain driving engagement with cross shaft 38. Horizontal bevel gears 44*a*, 44*b* respectively mate with vertical bevel gears 42*a*, 42*b* to drive rollers 46*a*, 46*b* and control belts 30 by interengaged spur gears or chain drive means 49*a*, 49*b*** as illustrated.

In summary, it can be seen that the conveyor apparatus of the invention provides a much needed and useful conveying apparatus for ensuring that a product passing from the sealing mechanism of a film wrapping packaging machine is firmly gripped. Thus, proper registry and minimum air retention within the package are assured.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A reciprocating conveyor apparatus, comprising:

(a) a frame capable of being moved reciprocally along a linear path;

(b) means for reciprocatingly moving said frame along said linear path;

(c) a belt conveyor mounted rotatably on said frame and capable of transporting a product in a direction substantially parallel to said path; and (d) means for rotatably driving said belt conveyor and being operative so that when said frame and said belt conveyor reciprocate in a first direction, said belt conveyor is driven and rotates, and when said frame and said belt conveyor reciprocate in a second direction, said belt conveyor is not driven and does not rotate.

2. A conveyor apparatus, comprising:

(a) a belt conveyor having at least one run capable of engaging and conveying a product contacting the run;

(b) a reciprocable frame mounting said belt conveyor;

(c) means for reciprocating said frame along a linear path; and (d) means for driving said belt conveyor in coordination with reciprocation of said frame wherein when said frame reciprocates and moves said run in a first direction to an entry position suitable for engaging said product said belt conveyor is driven, and when said frame next reciprocates and moves said run in a second opposite direction, said belt conveyor is not driven and causes said run to convey said product for the extent of said next reciprocation to an exit position.

3. A conveyor apparatus as claimed in claim 2 wherein said belt conveyor comprises a horizontal belt conveyor.

4. A conveyor apparatus as claimed in claim 2 wherein said belt conveyor comprises a vertical belt conveyor.

5. A conveyor apparatus as claimed in claim 2 wherein said means for reciprocating said frame and driving said belt conveyor comprises a drive motor.

6. A conveyor apparatus as claimed in claim 2 wherein said means for reciprocating said frame operates in synchronism with a reciprocable sealing bar mechanism associated with film wrapping said product.

7. A conveyor apparatus, comprising:

(a) a pair of vertically oriented opposed belt conveyors each rotatable in a substantially horizontal path separated by a space such that a product located between opposed runs thereof is gripped securely therebetween;

(b) a reciprocable frame mounting said pair of belt conveyors;

(c) means for reciprocating said first reciprocable frame along a linear path; and (d) means for driving said pair of belt conveyors in coordination with and during reciprocation of said reciprocable frame in a first direction to an entry position suitable for engaging a product to be conveyed and during the next reciprocation of said frame in a second direction not driving said belt conveyors.

8. A conveyor apparatus as claimed in claim 7 wherein said means for reciprocating said frame and driving said belt conveyors comprises a drive motor.

9. A conveyor apparatus as claimed in claim 7 further comprising means to selectively vary the space separating said vertically oriented opposed belt conveyors so as to adapt to products having different widths.

10. A conveyor apparatus as claimed in claim 7 including:

(a) a second belt conveyor having a horizontal run portion thereof operable in a direction parallel to the direction of rotation of and located below and between said vertically oriented belt conveyors;

(b) a second reciprocable frame mounting a portion of said second belt conveyor;

(c) means for reciprocating said second reciprocable frame along a linear path in the same direction and in coordination with reciprocation of said first reciprocable frame;

(d) means for continuously driving said horizontal run portion in said second direction; and (e) wherein said first and second reciprocable frames reciprocate from an upstream entry position suitable for engaging a product to be conveyed and next reciprocate in the second opposite direction to an exit position.

11. A conveyor apparatus as claimed in claim 10 wherein said second reciprocable frame comprises part of a gap type conveyor used with a reciprocating film sealing head mechanism.

12. A conveyor apparatus as claimed in claim 10 wherein said first and second reciprocable frames are connected together and are reciprocally driven in unison by a common drive mechanism.

13. A conveyor apparatus as claimed in claim 10 wherein said second reciprocable frame is located upstream of said first reciprocable frame.

14. A reciprocating conveyor drive system, comprising:

(a) a machine frame;

(b) a pair of parallel plates mounted on said machine frame and able to reciprocate linearly;

(c) a conveyor belt rotatably mounted to said pair of plates and having a product transporting surface;

(d) means mounted on said machine frame and operative to rotatably drive said conveyor belt at a selected speed in a selected direction; and (e) drive means to cause said pair of parallel plates to reciprocate at a speed equal to the linear speed of said conveyor belt so that when said plates reciprocate in the same direction as said product transporting surface of said conveyor belts, said conveyor belt rotation speed is zero.

* * * * *

UNITED STATES PATENT AND TRADEMARK OFFICE

CERTIFICATE OF CORRECTION

PATENT NO. : 5,269,119

DATED : December 14, 1993

INVENTOR(S) : Sidney S. Tolson

It is certified that error appears in the above-identified patent and that said Letters Patent is hereby corrected as shown below:

Column 7, line 18, correct "based" to read --bevel--.

Column 7, line 19, correct "52b" to read --42b--.

Col. 8,
In line 7 of claim 7, insert --first-- before "reciprocable".

Col. 8,
In line 12 of claim 7, insert --first-- after "said".

Col. 8,
In line 16 of claim 7, insert --first reciprocable-- before "frame".

Col. 8,
In line 2 of claim 8, insert --first reciprocable-- before "frame"

Signed and Sealed this

Third Day of May, 1994

Bruce Lehman

*Attest:*

BRUCE LEHMAN

*Attesting Officer*

*Commissioner of Patents and Trademarks*